US007237318B2

(12) United States Patent
Annamaa et al.

(10) Patent No.: US 7,237,318 B2
(45) Date of Patent: Jul. 3, 2007

(54) METHOD FOR PRODUCING ANTENNA COMPONENTS

(75) Inventors: Petteri Annamaa, Oulunsalo (FI); Kimmo Antila, Kiviniemi (FI); Ilkka Niemla, Oulu (FI); Heikki Riekki, Oulu (FI)

(73) Assignee: Pulse Finland Oy, Kempele (FI)

( * ) Notice: Subject to any disclaimer, the term of this patent is extended or adjusted under 35 U.S.C. 154(b) by 363 days.

(21) Appl. No.: 10/800,081

(22) Filed: Mar. 8, 2004

(65) Prior Publication Data

US 2004/0244187 A1 Dec. 9, 2004

(30) Foreign Application Priority Data

Mar. 31, 2003 (FI) ..... 20030472

(51) Int. Cl.
*H01P 11/00* (2006.01)

(52) U.S. Cl. ..... 29/600; 29/601; 343/700 MS; 343/702

(58) Field of Classification Search ..... 29/825, 29/832–835, 600, 601.2; 343/700 MS, 702, 343/895, 806, 746–747
See application file for complete search history.

(56) References Cited

U.S. PATENT DOCUMENTS 6,147,661 A * 11/2000 Nakagawa et al. ..... 343/895
6,281,842 B1 * 8/2001 Moren ..... 343/700 MS
6,337,662 B1 * 1/2002 Cassel ..... 343/702
6,535,167 B2 * 3/2003 Masuda et al. ..... 343/700 MS
6,538,604 B1 * 3/2003 Isohatala et al. ..... 343/700 MS
6,573,869 B2 * 6/2003 Moore ..... 343/702
6,822,609 B2 * 11/2004 Mendolia et al. .... 343/700 MS
6,897,808 B1 * 5/2005 Murch et al. ..... 343/700 MS
2002/0145567 A1 10/2002 Spiegel et al.

FOREIGN PATENT DOCUMENTS

WO WO-99/67851 A1 12/1999
WO WO-03/067705 A1 8/2003

* cited by examiner

*Primary Examiner*—Minh Trinh
(74) *Attorney, Agent, or Firm*—Darby & Darby

(57) ABSTRACT

A method for producing internal antenna components for small radio devices. A radiator is supported by a flat-topped protrusion formed in a plastic blank—e.g., by pressing with a hot tool. The length of the protrusion sets the height of the planar antenna. The radiator and its conductors are formed by removing material from a conducting film attached to the top of the protrusion. A feed and a shorting conductor are formed as extensions of the radiator. Contacts are attached to the feed and the shorting conductor to connect the antenna component to the radio device. Elongated gaps made in the plastic blank around the edges of the protrusion can facilitate loosening of the component. A plurality of antenna components can be formed on a uniform plastic blank and placed in a common package. The method results in low manufacturing costs and quick production time.

18 Claims, 4 Drawing Sheets

METHOD FOR PRODUCING ANTENNA COMPONENTS

BACKGROUND OF THE INVENTION

The invention relates to a method for producing components suitable for internal radiators, particularly in small-sized radio devices.

A growing number of different mobile phones and other small-sized radio devices are on the market for different telecommunication needs and for customers with different solvency. Regarding the price it is of course desirable that the device assortment extends as low as possible. The price of a device depends mainly on its manufacturing costs, which therefore must be forced low, particularly in cheap models.

This description depicts one possibility to reduce the manufacturing costs of a radio device, regarding the antenna. In practice the antennas located in small-sized radio devices have a planar structure: The antenna comprises a radiating plane and a ground plane in parallel with it. For instance in mobile phones a common way to make a planar antenna is that a dielectric support frame is formed by injection molding, and the radiating plane with its feeding and shorting conductors is made of metal sheet by cutting and bending. The support frame and the radiating plane are fastened to each other, and the resulting component is attached to a circuit board with the ground plane on its surface. Disadvantages of the method are the high costs required by the production line and the relatively long throughput time in the production. A simpler method is for instance to utilise printed circuit board techniques: a larger number of mutually identical radiator patterns are formed on a surface of a relatively large circuit board, and then the board is cut into pieces. Then the individual radiators are relatively cheap, as are their support mechanisms. However, the assembly of the antenna with its feeding and shorting conductors causes significantly high costs.

Usually a radio device as a whole is produced in a different place than its antenna component. In that case, by using known antenna manufacturing methods the antenna components are then packed one by one for the transport, which causes a significant extra cost.

SUMMARY OF THE INVENTION

The object of the invention is to reduce said disadvantages relating to prior art. The method according to the invention is characterised in what is presented in the independent claim 1. Some preferred embodiments of the invention are presented in the dependent claims.

The basic idea of the invention is as follows: In order to support a radiating planar element, or a radiator, a protrusion is formed on a planar plastic blank, for instance by pressing with a hot tool. The height of the protrusion is the designed height of the planar antenna. The actual antenna with its conductors is formed by removing material from a conducting film, which is on the plastic blank, or attached to the top of the protrusion. The feeding conductor and the shorting conductor of the antenna are formed as extensions of the radiator and located on a surface of the protrusion. Both to the feeding and to the shorting conductors is attached a contact in order to connect the antenna component later to a radio device. Elongated gaps can be formed at the edges of the protrusion, in the plane of the plastic blank, in order to facilitate the loosening of the component. A plurality of antenna components is formed on a uniform plastic blank, whereby the components can be finally placed in a common package.

An advantage of the invention is that the manufacturing costs of a single antenna are low compared to prior art. This is due to the fact that the shaping of the plastic plane mentioned above is cheap compared to injection moulding, and to the fact that the mass production of the antenna components and their installation in the final product are carried out in an easier manner. A further advantage of the invention is that the throughput time of the antenna components in the production is relatively short. A further advantage of the invention is that it is not necessary to pack the antenna components one by one, but a relatively large amount can be packed in one operation.

BRIEF DESCRIPTION OF THE DRAWINGS

The invention is described in detail below. In the description reference is made to the enclosed drawings, in which.

DETAILED DESCRIPTION OF THE INVENTION

Figure 1:
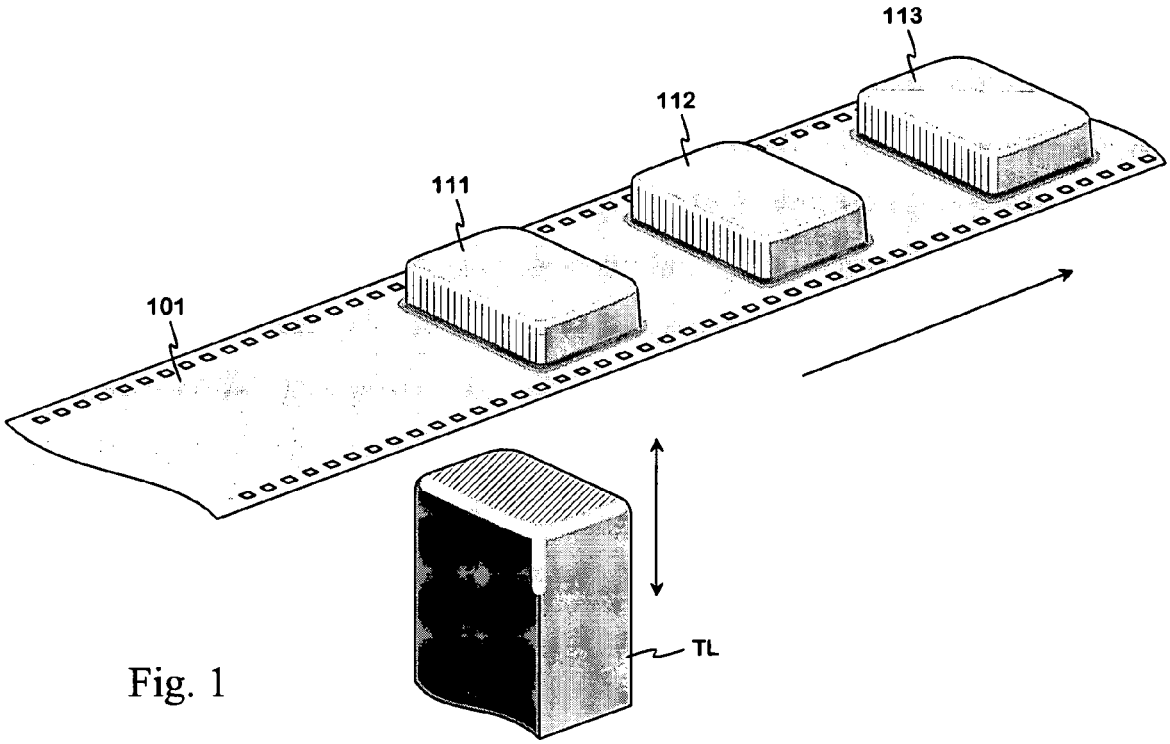
FIG. 1 shows an example of the initial phase in the production of antenna components according to the invention.

FIG. 1 shows an example of the initial phase in the production of antenna components according to the invention where a dielectric support is formed for the radiator of the antenna. The basis is a tape-like plastic blank 101. In FIG. 1 a pushing head TL of a machine tool presses from below against the tape, which pushing head is heated so that the plastic is plasticized during the pushing phase. This results in a recess in the tape with the form of the pushing head; seen from above this is a protrusion. The top surface of the protrusion in this example has the form of a slightly rounded rectangle, which is planar and parallel with the basic plane of the plastic blank. The four side surfaces of the protrusion are almost perpendicular to the basic plane of the plastic blank. The motion of the pushing head is dimensioned so that the height of the protrusion will become the designed height of the planar antenna. When a certain protrusion is ready the tape-like plastic blank is moved slightly further in order to make the next protrusion. In this example the edges of the tape are perforated for controlled tractor pull. FIG. 1 shows three successive plastic protrusions 111-113.

Figure 2:
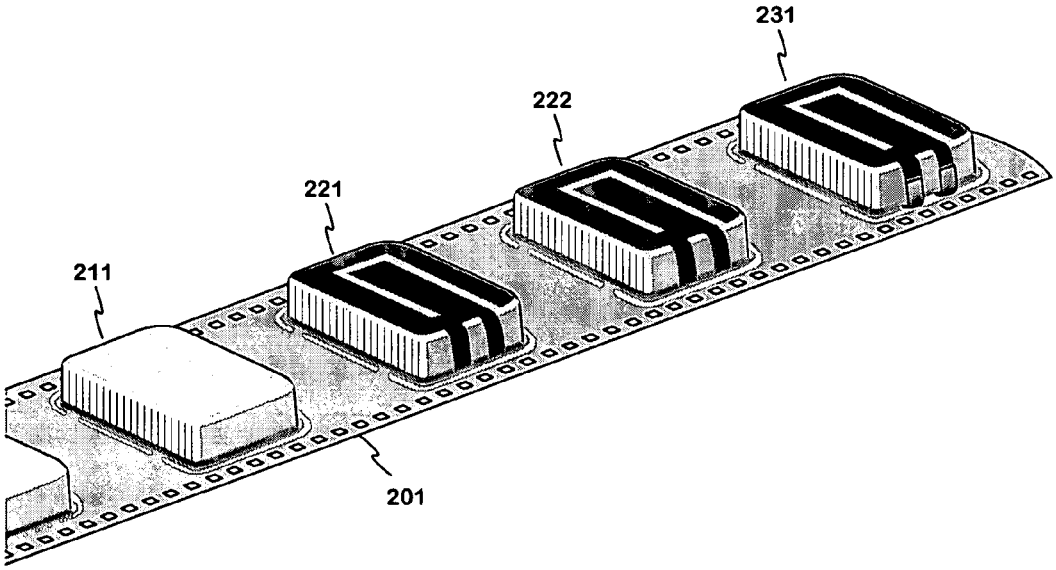
FIG. 2 shows the phase following the production phase shown in FIG. 1.

FIG. 2 shows an example of the phase in the production of the antenna components after the phase seen in FIG. 1. Successive formations for antenna components are located on a plastic tape 201. The latest formation 211 of these is similar to the protrusions 111-113 of FIG. 1 mentioned above. In addition there are elongated gaps formed at the edges of the protrusion in the plane of the plastic blank for an easy removal of the future antenna component. The second formation 221 in front of the protrusion 211 on the plastic tape 201 is older. A film-like radiator is located on the top surface of the second formation 221, and the feeding and shorting conductors of the future antenna are located on the side surface shown in the foreground. The radiator and the related feeding and shorting conductors are formed by removing material from a larger conductive film, accomplished for instance by vaporising conductive material with laser techniques. Thereafter the radiator, the feeding conductor and the shorting conductor are fastened to the plastic surface for instance with glue or a self-fastening joint. FIG. 2 shows further a third 222 and a fourth formation 223 of the successive formations. The former of these is similar to the second formation; in the later of these a spring contact is fastened both to the feeding and shorting conductors in order to connect the antenna component to a radio device in a conjunction of the future mounting.

The protrusions, acting as support for the radiator, can be made also by a deep drawing technique, instead of pressing by a hot pushing head. An alternative to the attachment of a finished radiator is that the whole plastic blank is first coated with a conductive film, on which a radiator pattern and the feeding and shorting conductors are machined before making the protrusion. In this case it is no more necessary to attach the radiator, of course. However, the conductive film must be left unfastened to the plastic blank at that strip where the feeding and shorting conductors will be located, and these are finally fastened to the sides of the protrusions.

Figure 3:
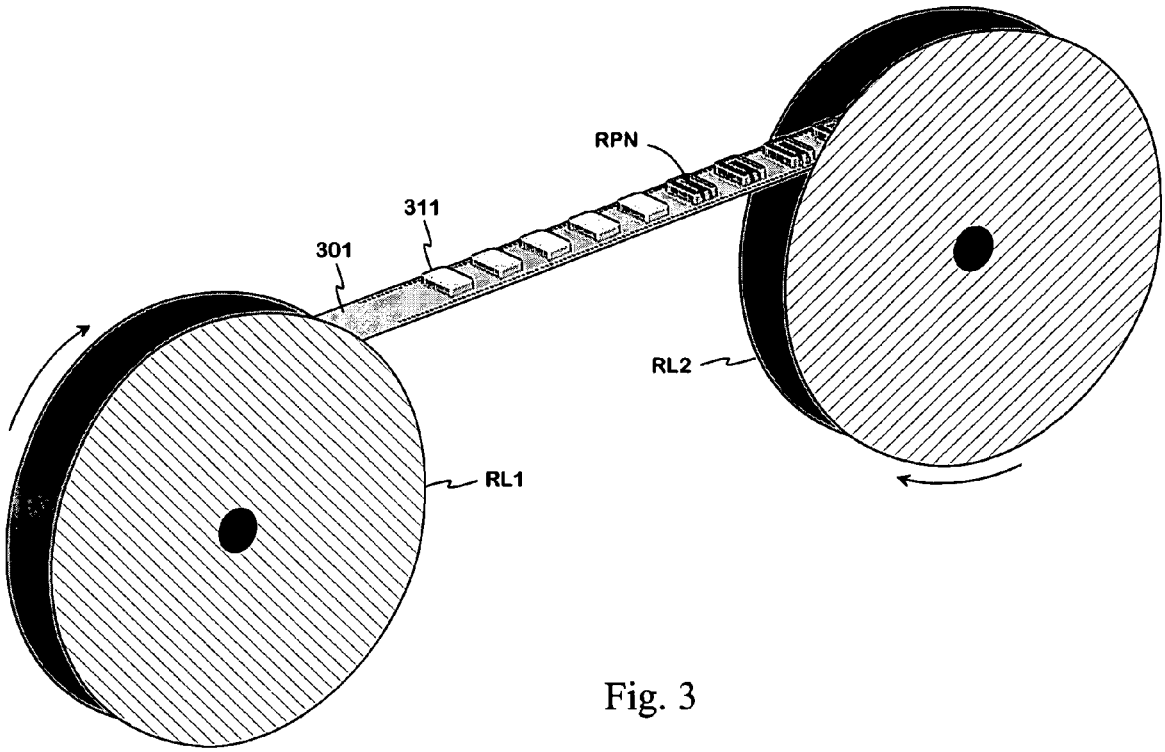
FIG. 3 shows an example of accumulating antenna components according to the invention into a package.

FIG. 3 presents a simplified example of a production line for antenna components, showing the beginning and end of the line. The tape-like plastic blank 301 is initially wound on a first coil former RL1. From here its first end is pulled to the line, of which no equipment is drawn in the figure. The tape has successive formations of antenna components in different stages of the production, such as the last plastic protrusion 311. At the output end of the line the antenna components are ready, and each of them has i.a. a radiator RPN. The tape carrying the ready antenna components is wound on a second coil former RL2. In this way the products in question will be packed already in connection carrying the production process. Lastly it is only necessary to put the receiving coil in a protective package. Alternatively the tape carrying the ready antenna components at the end of the line is cut into pieces of fixed length, comprising for instance ten components. These straight pieces are then put into a common package.

Figure 4:
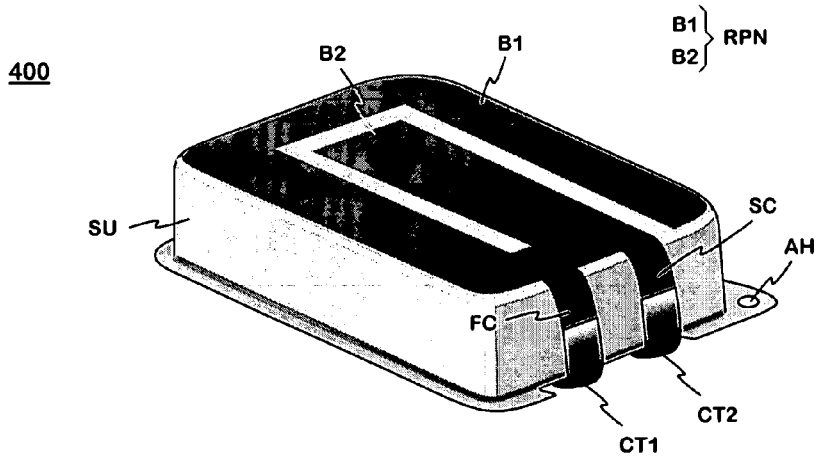
FIG. 4 shows an example of a finished antenna component, which has been loosened from its base.

FIG. 4 shows an example of a finished antenna component, which has been loosened from its base. The antenna component 400 has a support part SU of plastic, a radiator RPN, and a feeding conductor FC and a shorting conductor SC on one of the shorter side surfaces. In this example the radiator consists of a first conductor strip B1, which extends along the borders of the top surface on the support part, and of a second conductor strip B2 being located in the middle area of the topsurface. The first conductor strip seen from the connection point of the shorting conductor is clearly shorter than the second strip, and therefore the finished antenna is a two-band antenna.

Further the antenna component 400 comprises contacts in order to connect it electrically to the final product. In this example the contacts are of the spring type. The first spring contact CT1 is connected fixedly to the antenna's feeding conductor FC, and the second spring contact CT2 is fastened to the shorting conductor SC. The connections are made for instance by spot welding. The free ends of both contacts are bent below the antenna component. When the component is mounted in a radio device the first spring contact CT1 will be connected to the antenna port of the radio device and the second spring contact CT2 will be connected to the antenna's ground plane. This provides an antenna of the PIFA type (Planar Inverted F-Antenna). For the mechanical attachment of the antenna component an attachment hole AH is visible in the flange-like lower edge of the support part.

Figure 5:
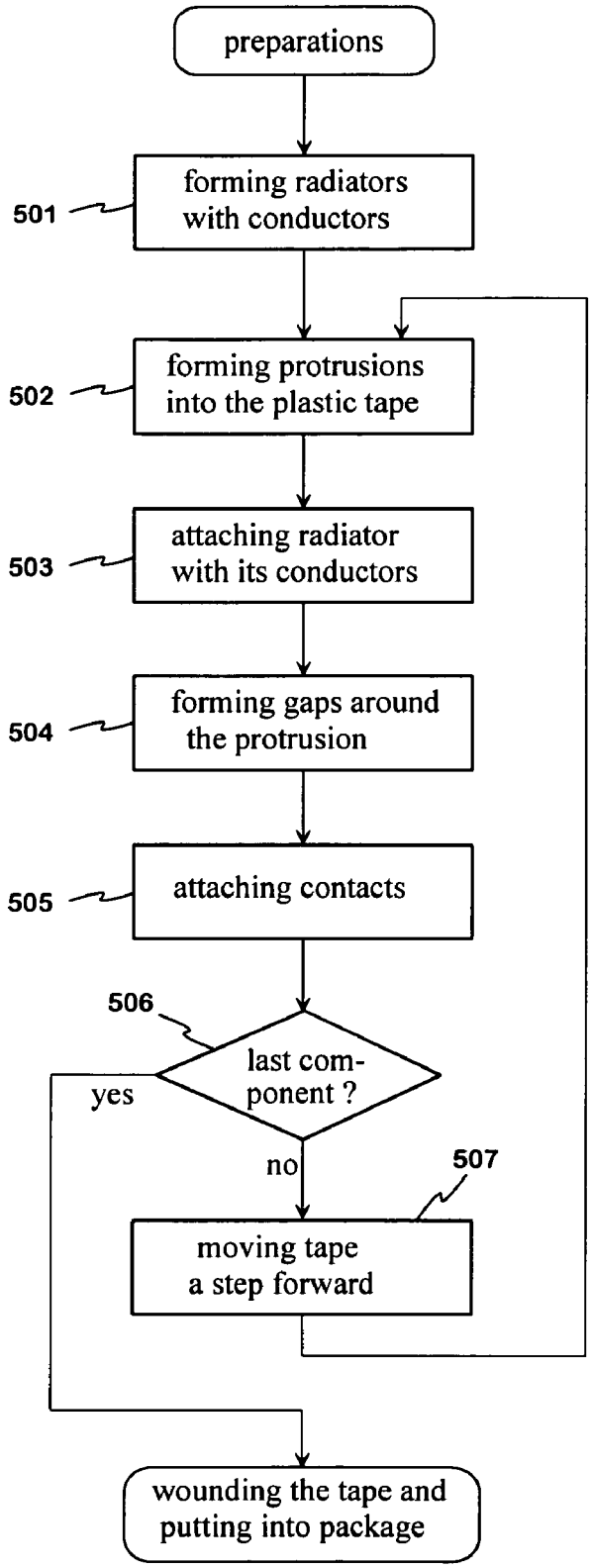
FIG. 5 shows in a flowchart an example of a method according to the invention.

FIG. 5 shows in a flowchart an example of a method according to the invention. The example corresponds to the arrangement shown in FIGS. 1 to 3. After preliminary preparations of the production line, in step 501, conductor patterns are formed in a conductive film, each pattern including the antenna's radiator and the feeding and shorting conductors, the number of patterns corresponding to a production batch. In step 502 a protrusion, intended to be an antenna support part, is formed into the plastic tape on the production line. In step 503 the radiator with its conductors is attached to the surface of the protrusion. This protrusion can be a few bosses older than that protrusion, which was last formed, so that the plastic has time to cool down after the processing. In step 504 the required gaps are formed around the protrusion, at least for the attachment of the contacts. In addition it is possible to form elongated gaps, so that the component can be later loosened without cutting tools, as well as other openings for mounting the component. In step 505 a contact is attached both to the feeding conductor and to the shorting conductor. In step 506 it is checked whether the previous step concerned the last antenna component of the production batch. If not, then the tape is moved forward a distance corresponding to the distance between two successive components according to step 507, and the process returns to step 502. If the component in question was the last component, then in this example the rest of the tape is wound on the receiving coil former, and the coil is put into its package.

Figure 6:
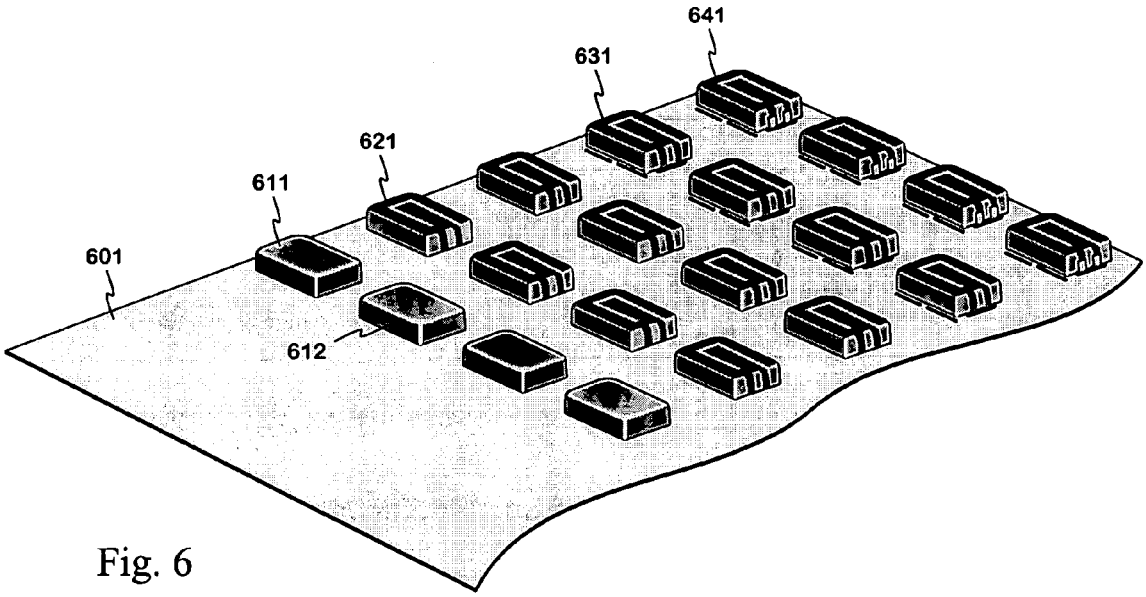
FIG. 6 shows another example of an arrangement according to the invention.

FIG. 6 shows another example of an arrangement according to the invention. There the plastic blank 601 for the antenna components is plate-like, and the antenna components are formed one row at a time. In the example of FIG. 6 the rows are straight, so that a plurality of antenna components are formed in a matrix form. The left end area of the plate 601 in the figure is still in the initial state. Further to the right there is a first row comprising simple plastic protrusions, such as the protrusions 611 and 612. Then there are the second and third rows, where a radiator and feeding and shorting conductors are formed on the outer surface of each protrusion. This results in intermediate formations, such as the first intermediate formation 621 in the second row. In the fourth row the required gaps are made in the plane of the plate around the formations, such as around the formation 631, for fastening of contacts and for the later loosening of the whole component. In the fifth row the contacts are attached to the feeding and shorting conductors in the formations. This provides the finished antenna components, such as the first component 641 of the row, except that they must be loosened.

Figure 7:
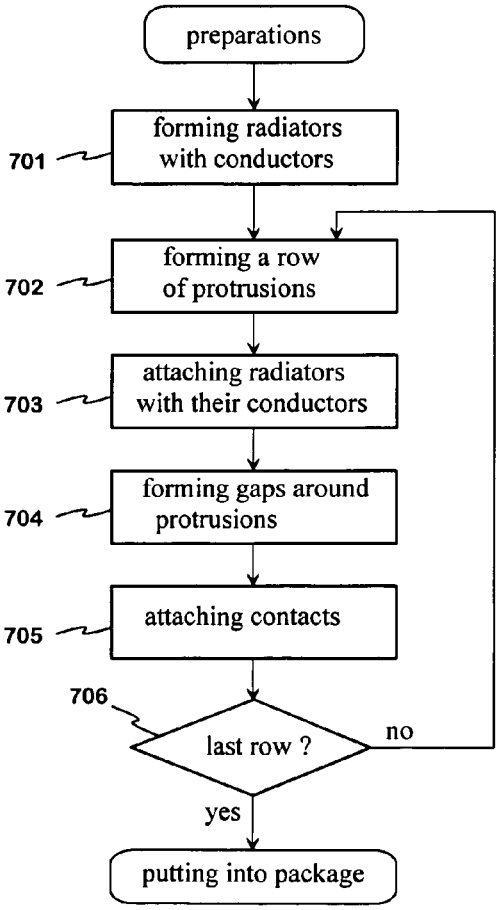
FIG. 7 shows a flowchart an example of a method corresponding to FIG. 6.

FIG. 7 shows in a flowchart another example of a method according to the invention corresponding to the arrangement in FIG. 6. After preliminary preparations of the production line, in step 701, conductor patterns are formed in a conductive film, each pattern including the antenna's radiator and the feeding and shorting conductors, the number of patterns corresponding to a production batch. In step 702 a row of protrusions, intended to become antenna support parts, are formed into the plastic plate on the production line. In step 703 the radiators with their conductors are attached to the protrusions in one row. In step 704 the gaps mentioned above are formed around the protrusions, for one row. In step 705 contacts are attached to the feeding and shorting conductors in one row. In step 706 a check is made to see whether the previous step concerned the last antenna component row of the production batch. If not, then the process returns to step 702. If the row in question was the last row, the antenna component plate is put into its package.

Above is described a method according to the invention. The invention is not limited just to the cases described above. The order of the operations can vary to some degree, and concerning for instance the embodiments of FIGS. 6 and 7 a varying number of antenna components can be simultaneously subject to actions. The invention does not restrict the shape of the antenna elements. The plastic protrusion acting as the support for a radiator can be even almost round instead of rectangular, and it can be convex instead of flat-topped. The radiating conductor with its feeding and shorting conductors can also be located on the inner surface of the protrusion instead of on its outer surface. Likewise, the invention does not restrict the materials used in the antenna component, except for the mandatory limitations regarding functionality. The inventive idea is applicable in different ways within the limits imposed by the independent claim 1.

The invention claimed is:

1. A method for producing antenna components for a planar antenna, the method comprising:

forming an antenna radiator, feed conductor and shorting conductor on a uniform conducting layer;

machining a protrusion into a planar plastic blank to create a dielectric supporting part, wherein the protrusion has a height which is a designed height of the planar antenna;

fastening the formed radiator, feed conductor and shorting conductor to the protrusion;

providing at least one opening in the planar plastic blank around said protrusion for the attachment of contacts for connecting the antenna component to a radio device; and attaching a contact, respectively, to the feed conductor and to the shorting conductor.

2. The method according to claim 1, wherein the plastic blank is a tape wound on a coil former, and further including the step of processing a plurality of antenna components in successive locations on the tape while the tape is unwound from said coil former.

3. The method according to claim 2, further including the step of winding said tape on a second coil former after the processing step.

4. The method according to claim 2, further including the step of cutting said tape into fixed-length pieces after the processing step.

5. The method according to claim 1, wherein the plastic blank is a plate, and further including the step of processing a plurality of antenna components row by row into the plate.

6. The method according to claim 1, wherein the machining step is performed by a hot tool.

7. The method according to claim 1, wherein the machining step is performed by a deep drawing technique.

8. The method according to claim 1, wherein the fastening step fastens the formed radiator, feed conductor and shorting conductor to an outer surface of said protrusion.

9. The method according to claim 1, wherein the fastening step fastens the formed radiator, feed conductor and shorting conductor to an inner surface of said protrusion.

10. The method according to claim 1, wherein said protrusion is flat-topped.

11. The method according to claim 1, wherein said conductors and radiator are attached by gluing.

12. The method according to claim 1, wherein said conductors and radiator are attached by a self-adhesive joint.

13. The method according to claim 1, further including the step of welding said contacts to the radio device.

14. The method according to claim 1, further comprising the step of forming openings in the planar plastic blank around said protrusion in order to facilitate removal of the antenna component from the plastic blank.

15. A method for producing antenna components for a planar antenna, the method comprising:

providing a planar plastic blank having first and second surfaces and including a conductive film attached to the first surface;

machining a protrusion into the planar plastic blank to create a dielectric supporting part, wherein the protrusion has a height which is a designed height of the planar antenna;

forming an antenna radiator, feed conductor and shorting conductor by removal of a portion of the uniform conducting layer on the protrusion;

providing at least one opening in the planar plastic blank around said protrusion for the attachment of contacts for connecting the antenna component to a radio device; and attaching a contact, respectively, to the feed conductor and to the shorting conductor.

16. The method according to claim 15, wherein the plastic blank is a tape wound on a coil former, and further including the step of processing a plurality of antenna components in successive locations on the tape while the tape is unwound from said coil former.

17. The method according to claim 16, further including the step of winding said tape on a second coil former after the processing step.

18. The method according to claim 15, wherein the plastic blank is a plate, and further including the step of processing a plurality of antenna components row by row into the plate.

* * * * *